US006063946A

United States Patent [19]

Miller et al.

[11] Patent Number: 6,063,946

[45] Date of Patent: May 16, 2000

[54] PROCESS FOR THE ISOLATION OF POLYUNSATURATED FATTY ACIDS AND ESTERS THEREOF FROM COMPLEX MIXTURES WHICH CONTAIN STEROLS AND PHOSPHORUS COMPOUNDS

[75] Inventors: Robert Alan Miller, Columbus; Terrence Bruce Mazer, Reynoldsburg, both of Ohio; Scott Donald Barnicki; Charles Edwan Sumner, Jr., both of Kingsport, Tenn.

[73] Assignee: Eastman Chemical Company, Kingsport, Tenn.

[21] Appl. No.: 08/592,797

[22] Filed: Jan. 26, 1996

[51] Int. Cl.[7] ..... C11C 1/00

[52] U.S. Cl. ..... 554/167; 554/169

[58] Field of Search ..... 554/167, 169

[56] References Cited

U.S. PATENT DOCUMENTS

| | | | |
|---|---|---|---|
| 4,104,286 | 8/1978 | Fallis et al. | 260/397.25 |
| 4,670,285 | 6/1987 | Clandinin et al. | 426/602 |
| 4,692,280 | 9/1987 | Spinelli et al. | 260/420 |
| 4,698,185 | 10/1987 | Dijkstra et al. | 260/403 |
| 4,857,236 | 8/1989 | Gunther | 260/403 |
| 5,084,215 | 1/1992 | Kearns et al. | 260/403 |
| 5,091,117 | 2/1992 | Athnasios et al. | 260/428 |
| 5,106,542 | 4/1992 | Traitler et al. | 554/186 |
| 5,112,956 | 5/1992 | Tang et al. | 530/424 |
| 5,130,061 | 7/1992 | Cornieri et al. | 554/167 |
| 5,250,719 | 10/1993 | Tronconi | 558/146 |
| 5,304,545 | 4/1994 | Mentink et al. | 554/212 |
| 5,342,633 | 8/1994 | Cully et al. | 426/47 |
| 5,424,467 | 6/1995 | Bam et al. | 554/189 |
| 5,616,359 | 4/1997 | Heidlas et al. . | |
| 5,750,180 | 5/1998 | Heidals et al. . | |

FOREIGN PATENT DOCUMENTS

| | | |
|---|---|---|
| 2118893 | of 0000 | Canada . |
| 2118894 | of 0000 | Canada . |
| 0 610 742 | 8/1994 | European Pat. Off. . |
| 1559064 | of 0000 | United Kingdom . |
| WO 80 02100 | 10/1980 | WIPO . |
| WO 89/11521 | 11/1989 | WIPO . |
| WO 91/03946 | 4/1991 | WIPO . |
| WO 94 21766 | 9/1994 | WIPO . |
| WO 96 14311 | 5/1996 | WIPO . |
| 97/26804 | 7/1997 | WIPO . |
| 97/27274 | 7/1997 | WIPO . |
| 97/27275 | 7/1997 | WIPO . |

OTHER PUBLICATIONS

Database WPI, Section Ch, Week 8709, Derwent Publications Ltd., London, GB; XP002032889 & JP 62 016 439 A (Nippon Oils & Fats Co., Ltd.,), Jan. 24, 1987.

Database WPI, Section Ch, Week 8432, Derwent Publications, Ltd., London, GB; Class B04, AN 84–198209, XP002032890 & JP 59 113 099 A (Oishi K), Jun. 29, 1984.

Database WPI, Section Ch, Week 9545, Derwent Publications Ltd., London, GB; Class D13, AN 95–348501, XP002030664 & JP 07 238 293 A (Bizen Kasei KK), Sep. 12, 1995.

Patent Abstracts of Japan, vol. 096, No. 011, Nov. 29, 1996 & JP 08 168390 A (Osaka City, Maruha Corp).

*Primary Examiner*—Deborah D Carr

*Attorney, Agent, or Firm*—Cheryl J. Tubach; Harry J. Gwinnell

[57] ABSTRACT

This invention relates to a process for the isolation of fatty acids and fatty acid esters from complex naturally occurring mixtures which contain sterols, triglycerides and phospholipids. A preferred embodiment of the invention comprises extracting lipids from egg yolk solids with methanol; separating lipids including sterols from insoluble egg yolk components; submitting the methanolic solution of lipids to (a) alkaline hydrolysis and subsequent neutralization to convert lipids to free fatty acids together with sterols; (b) separating the said sterols and acids from an aqueous phase formed in the hydrolysis reaction; (c) heating said free fatty acids and sterols to convert the sterols to fatty acid sterol esters; (d) subjecting the mixture to distillation to separate the sterol esters from the free fatty acids; and (e) subjecting the said acids to esterification in the presence of glycerol to produce triglycerides of said fatty acids wherein the resulting triglycerides contain reduced quantities of sterols and phosphorus. An enteral nutritional formula containing the triglycerides produced in the above process is also disclosed.

20 Claims, 1 Drawing Sheet

FREE FATTY ACID ROUTE FOR EGG PHOSPHOLIPID TO TRIGLYCERIDE CONVERSION

PROCESS FOR THE ISOLATION OF POLYUNSATURATED FATTY ACIDS AND ESTERS THEREOF FROM COMPLEX MIXTURES WHICH CONTAIN STEROLS AND PHOSPHORUS COMPOUNDS

FIELD OF THE INVENTION

This invention relates to a process for preparing fatty acid and fatty acid esters high in polyunsaturated fatty acids, which have low concentrations of cholesterol and other sterols, and phosphorus, and are derived from naturally occurring lipid mixtures. This invention also relates to an enteral nutritional formula containing triglycerides prepared by the process of this invention. The enteral formula can be used as an infant formula or as an adult nutritional.

BACKGROUND OF THE INVENTION

The composition of human milk serves as a valuable reference for improving infant formula. Much effort has been directed at producing a milk based infant formula which is similar to human milk.

One component of human milk that is receiving more investigation is the fat composition. Human milk fat contains long chain polyunsaturated fatty acids which may play a role in infant development. Many infant formulas do not contain lipids having long chain polyunsaturated fatty acids such as arachidonic acid (C20:4w6) (referred to herein as AA), eicosapentaenoic acid (referred to herein as EPA), and docosahexaenoic acid (C22:6w3) (referred to herein as DHA). Acceptable ingredient sources for these fatty acids are limited, thus the infant formula and adult nutritional industry is in need of additional supplies of these polyunsaturated fatty acids.

Polyunsaturated acids, in particular the longer chain acids such as AA, DHA, and EPA are natural constituents of many foodstuffs in the form of glycerides (mono-, di- and tri-) or phospholipids. However these acids are either intimately combined with undesirable components such as cholesterol, phosphorus compounds, or are unsuitable for food applications in their natural form.

The n-6 family of polyunsaturated fatty acids, based on the parent linoleic acid and higher derivatives such as AA, have long been established as essential in human and animal nutrition. More recently, evidence has accumulated for the nutritional importance of the n-3 family of polyunsaturated fatty acids, based on the parent linolenic acid and higher derivatives such as eicosapentaenoic acid (EPA) and docosahexaenoic acid (DHA). These polyunsaturated acids are the precursors for prostaglandins and eicosanoids, a powerful group of compounds which produce diverse physiological actions at low concentrations. The prostaglandins are known to influence blood clotting, inflammatory and anti-inflammatory response, cholesterol absorption, bronchial function, hypertension, visual acuity and brain development in infants, and gastric secretions, among other effects.

Polyunsaturated fatty acids are found in numerous plant and animal lipid fractions. Egg yolk contains AA (arachidonic acid) and DHA (docosahexaenoic acid). Lipids isolated from egg yolks are unacceptable for use in infant formula due to high levels of cholesterol and troublesome levels of phosphorus. The AA and DHA are present in egg yolk lipids primarily as phospholipids. Thus, infant formulas fortified with egg yolk lipids have levels of cholesterol and phospholipids which far exceed the level of such compounds found in breast milk.

Typically, the amount of lipids in egg yolk is about 65% by weight (wt %) of the dry matter. In such lipids, about 66 wt % of the lipid is triglycerides, of which about 30 wt % is phospholipids, and about 4 wt % is cholesterol. The phosphorus content of the lipids is about 1 wt % to 2 wt %.

Several commercial egg lipid ingredients are presently available. The first, OVOTHIN 120, is a total egg yolk lipid extract supplied by Lucas Meyer of 765 East Pythian Ave., Decatur, Ill. 62526. OVOTHIN 120 contains triglyceride, phospholipid and cholesterol. A second ingredient, supplied by Pfanstiehl Laboratories, Inc. of 1219 Glen Rock Ave., Waukegan, Ill. 60085 is an egg yolk extract which is 90% phospholipids. Also, purified egg phospholipid is available from Genzyme Corporation of One Kendill Square, Cambridge, Mass. 02139. Unfortunately, all the above ingredients negatively impact the phosphorus levels of infant formula when used at the proper fortification level to achieve AA and DHA target levels approximating the content of AA and DHA in human milk. The proper fortification would require that about 7–9 wt % of the fat in the infant formula be composed of phospholipid. Human milk fat contains 1–3 wt % phospholipid. Furthermore, the use of a material like OVOTHIN 120 increases cholesterol in infant formula above the levels found in human milk.

There are numerous methods in the literature for recovering phospholipids from lipid mixtures. For example, U.S. Pat. No. 4,698,185 discloses a method of separating phospholipids from crude vegetable triglyceride mixtures. The method involves the addition of water in a mass ratio about equal to the mass of phospholipids present in the lipid mixture, with or without heating, and with or without co-addition of citric or phosphoric acid, to cause the phospholipids to hydrate and separate into a second phase.

Such degumming methods, however, were designed for the removal of 1 to 2 weight percent of phospholipids from crude vegetable triglycerides and are not directly applicable to the purification of other natural lipid mixtures, such as egg yolk lipids because of the higher levels of phospholipids (30–40 wt %) in eggs. Addition of a 1:1 mass ratio of water to phospholipid with large amounts of phospholipids present causes the formation of a stable emulsion which prevents phase separation. Moreover, sterols tend to partition between both the phospholipid and triglyceride phases.

It is desirable to provide a process by which cholesterol and other sterol compounds (many of which can be metabolized to cholesterol or its derivatives) can be extracted from various foodstuffs, thereby producing low-cholesterol versions of such foodstuffs. However, the process must not introduce into the foodstuff any material which is not generally recognized as safe for use in foodstuffs. In addition, the process should remove from the foodstuff not only cholesterol itself but also cholesterol derivatives and other sterol compounds which can be metabolized in the body to cholesterol or derivatives thereof, and which thus affect cholesterol levels in the body. Furthermore, the process should leave the foodstuff in a form which is as close as possible to that of the original, high cholesterol foodstuff.

Numerous attempts have previously been made to provide a cholesterol-removal process which meets these exacting criteria. U.S. Pat. No. 4,692,280, discloses a process for the purification of fish oils in which the oil is extracted with supercritical carbon dioxide to remove cholesterol, together with odoriferous and volatile impurities. Such carbon dioxide extraction processes, however, suffer from the disadvantage that they must be operated under pressure to keep the carbon dioxide in the supercritical phase, which increases the cost of the apparatus required.

U.S. Pat. No. 5,091,117 discloses a process for removing at least one sterol compound and at least one saturated fatty acid from a fluid mixture by contacting the fluid mixture with an activated charcoal. U.S. Pat. No. 5,091,117 states however, in column 12, lines 4–19, that the process should not be used for removing cholesterol from materials, such as egg yolks which contain a combination of cholesterol and proteins, since a significant adsorption of proteins and their constituent amino acids occurs on the charcoal.

British Pat. No. 1,559,064 discloses a process for removing cholesterol from butter triglycerides by distillation. However, Lanzani et al [J. Am. Oil Chem. Soc. 71, (1994) 609] determined that only 90% of the cholesterol could be removed using the process disclosed in British Pat. No. 1,559,064 without seriously affecting the quality of the end product. Excessive time at the high temperatures needed for more complete cholesterol removal was found to cause cis-trans isomerization of the polyunsaturated fatty acids. The trans form of polyunsaturated fatty acids are considered undesirable in food products.

U.S. Pat. No. 4,670,285 to M. Clandinin of Jun. 2, 1987 discloses the use of lipid extracted from egg yolk in infant formula. The lipids of the Clandinin reference include polyunsaturated lipids found in human milk such as C:20 or C:22 w6 and C:20 or C22 w3 fatty acids. The lipids of Clandinin contain the unacceptable levels of cholesterol and phosphorus of the original egg yolk material.

Abstract of JP 62198351 of Sep. 2, 1987 to Morinaga Milk discloses a substitute mothers' milk composition which contains egg yolk lipid extracted from egg yolk with ethanol. The lipid is preferably combined so that a 100 g milk composition contains 68 mg of cholesterol. However, the 68 mg of cholesterol translates to about 680 mg/L (liter) or greater than four times that found in human milk.

U.S. Pat. No. 5,112,956 of May 12, 1992 to P. Tang, et al. discloses a method for the removal of lipids and cholesterol from protein material such as that in egg yolk by treating the protein with an extraction mixture comprising a lower alcohol, water, and an acid in concentrations selected to extract cholesterol and lipids from the protein. The preferred lower alcohol of this reference is ethanol and a primary object is obtaining protein suitable for human consumption.

PTC publication WO 89/11521 of Nov. 30, 1989 discloses a process for preparing EPA and DHA and their esters from oils of animal and/or vegetable origin by subjecting the raw oil to alkaline hydrolysis, acidifying the soap so formed with a mineral acid in aqueous solution, extracting the resulting mixture with petroleum ether and after washing and concentration, the combined extracts are submitted to one or more distillation steps with the pressure and temperature parameters being suitably changed in order to obtain a whole range of desired products.

Abstract of JP 1160989 (application) of Jun. 23, 1989 to NIOF. Fresh fish eggs are extracted with solvent of distilled water, methanol/chloroform, acetone, ether, under oxygen-free conditions to extract lipids and eventually isolate a docosahexaenoic acid-containing phosphatidylcholine.

Abstract of Han'guk Ch'uksan Hakhoechi, 1991, 33(8), 602–6 by Han, C. K., et al. Egg yolk was ground with trichloromethane and methanol. Lipid extract was converted to methyl esters by transesterification with boron trifluoride and methanol. The methyl esters were analyzed for various fatty acids. C20–22 polyunsaturated acids accounted for 4.3% of the total.

In an embodiment of the present invention, egg yolk derived glyceride compositions, also simply referred to herein as Processed Natural Ingredients, are prepared which typically contain about 4 wt % of AA and about 1.5 wt % of DHA based on the weight of the Processed Natural Ingredients and wherein the amount of phosphorus can be reduced to less than about 0.002 wt % (20 ppm) and the amount of cholesterol reduced to less than about 0.1 wt % of the Processed Natural Ingredients. Preferably at least 95% and particularly at least 98% of the cholesterol and other sterols, and phosphorus compounds are removed from the lipid mixture staring material, e.g. egg yolks in the process of this invention, and such highly purified fatty acids or esters thereof are referred to herein as being "essentially free of cholesterol, sterols and phosphorus compounds". The Processed Natural Ingredients can be in the form of mono-, di-, or triglycerides as well as mixtures thereof.

Unless the context indicates otherwise, the following terms shall have the following meaning:

"AA" is arachidonic acid (C20:4w6);

"alkaline metal" is an alkaline earth metal or alkali metal such as calcium, magnesium, sodium, or potassium;

"DHA" is docosahexaenoic acid (C22:6w3);

"egg derived triglycerides" are one of the Processed Natural Ingredients (as defined below) wherein a major portion, preferably at least 75% by weight of the glycerides and particularly at least 90% of the glycerides are triglycerides derived from egg yolk;

"essentially free of cholesterol, sterols, and phosphorus compounds" means that at least 95%, preferably at least 98%, of the cholesterol and other sterols, and phosphorus compounds are removed from a lipid starting material by the process of the present invention;

"FAP" is fatty acid profile;

"free fatty acid route" is the process which comprises the isolation of free fatty acids by hydrolysis of naturally occurring lipid mixtures, separation of an aqueous phase from the fatty acid phase, reacting the fatty acids with the sterols to form sterol fatty acid esters and distilling the sterol fatty acid esters/fatty acid mixture;

"GC" is gas chromatography;

"lower alkane" is an alkane having from 1 to 4 carbon atoms;

"lower alkyl" is an alkyl having from 1 to 4 carbon atoms;

"lower alkanol" is a monohydric alcohol having from 1 to 4 carbon atoms;

"lower alkoxide" is an alkyl oxide group having from 1 to 4 carbon atoms such as in sodium methoxide;

"mL" means milliliter;

"N/AP" means not applicable;

"N/D" means not detectable;

"N/R" means not reported; and

"Processed Natural Ingredients" are the compositions containing glycerides prepared by reacting glycerol or polyhydric alcohols with the free fatty acids in the process of this invention;

"TLC" is thin layer chromatography.

DISCLOSURE OF THE INVENTION

Figure 1:
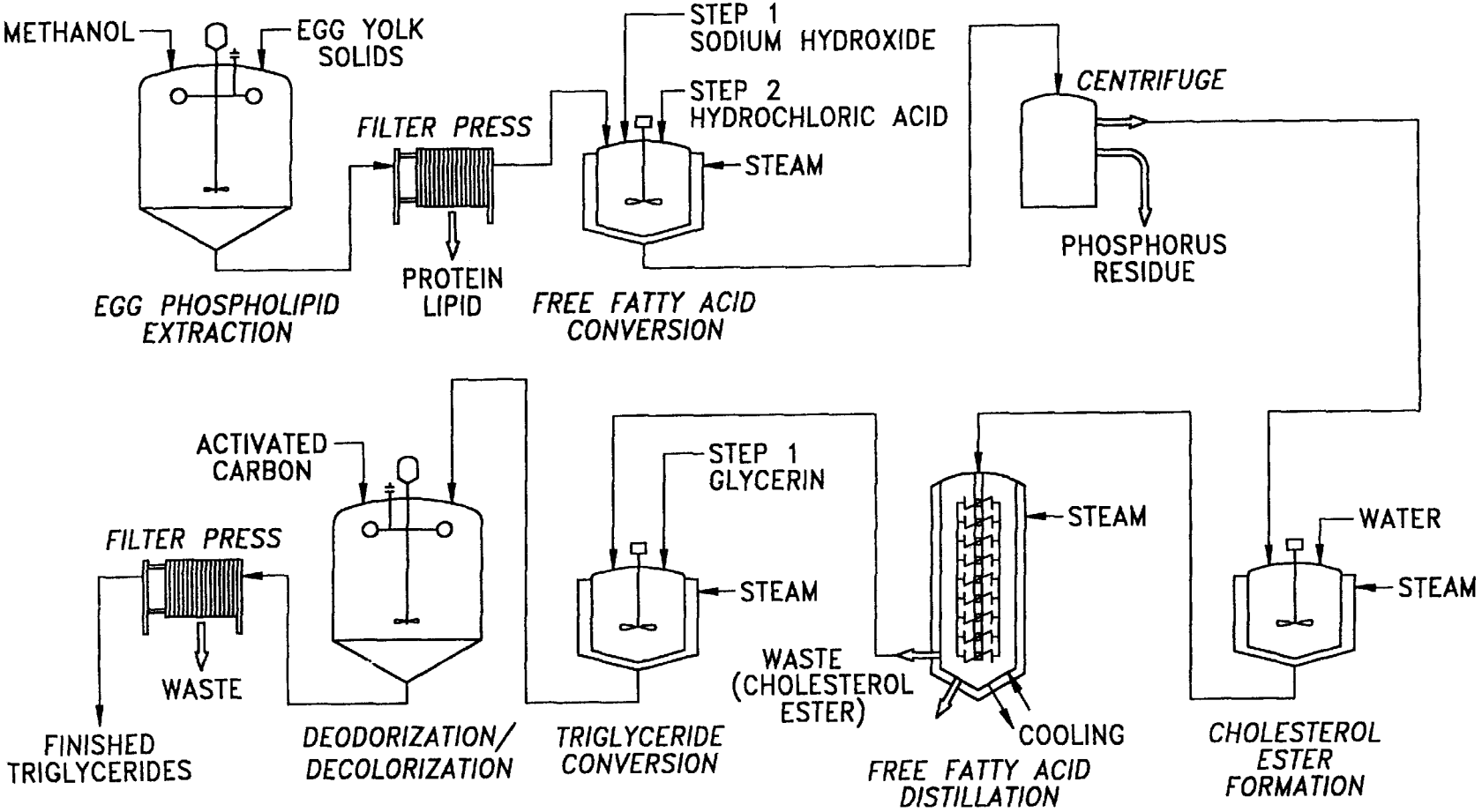
FIG. 1 is a schematic flow diagram entitled "FREE FATTY ACID ROUTE FOR EGG PHOSPHOLIPID TO TRIGLYCERIDE CONVERSION" and shows important steps of a preferred method for making the triglyceride composition of the Processed Natural Ingredients using methanol as the extraction solvent for lipids from egg yolk solids.

The present invention in general relates to a process for isolating polyunsaturated fatty acids from complex naturally occurring mixtures. The isolated polyunsaturated fatty acids are essentially free of cholesterol and other sterols and phosphorus. The sterols and the phosphorus compounds are removed without degrading or causing cis-trans isomerization of the polyunsaturated fatty acids. Moreover, the process of the present invention uses materials which are on the Generally Recognized As Safe (GRAS) list of the U.S. Food and Drug Administration.

In one aspect of the invention a lower alkanol is included with the lipid mixture to assist or cause the mixture to separate into a top phase comprising phospholipids, sterols and alcohol and a bottom phase comprising triglycerides and sterols. The top phase is then used for subsequent processing. In yet another aspect of the invention, a process is disclosed for preparing fatty acids and fatty acid esters essentially free of cholesterol, sterols, and phosphorous compounds from naturally occurring lipid mixtures, said process comprising the steps of:

(A) hydrolyzing a lipid mixture containing phospholipids, triglycerides, and sterols to form a two-phase product containing a fatty acid phase comprising free fatty acids and sterols, and an aqueous phase comprising water, glycerol, and glycerol phosphoric acid esters;

(B) separating the aqueous phase from the fatty acid phase of the two-phase product formed in Step (A);

(C) reacting the fatty acids with the sterols in the fatty acid phase from Step (B) at a temperature of about 150° C. to about 250° C. to form a mixture comprising sterol fatty acid esters and water; and (D) distilling the sterol fatty acid esters formed in Step (C) at a temperature of about 130° C. to about 250° C. and a pressure of about $1.0\times10^{-3}$ kPa to about $5.3\times10^{-1}$ kPa, to recover purified fatty acids which are essentially free of cholesterol, sterols, and phosphorus compounds; and optionally (E) reacting the purified fatty acids prepared in Step (D) with a monohydric or polyhydric alcohol in a molar ratio of 1 to 2 moles of fatty acid to each hydroxy equivalent of the alcohol to produce a fatty acid ester.

In still another aspect of the invention the egg yolk is extracted with a lower alkyl alcohol and the subsequent processing follows the steps described above. The use of methanol to extract lipids is advantageous, particularly at temperatures from about 20° C. to the boiling point of methanol, i.e., 68 degrees C., since the amount of lipid mixture extracted is unexpectedly greater in long-chain polyunsaturates in comparison with the use of other alkanols such as ethanol or propanol. Additionally, methanol is a solvent accepted for use in preparation of food ingredients.

In a further aspect of the invention purified free fatty acids, lower alkyl esters of the fatty acids, or mixtures thereof are recovered from the distillation step without proceeding to the esterification step.

Still further aspects of the invention include fractionation techniques for concentrating fatty acids such as AA and DHA.

This invention also relates to the free fatty acids and ester thereof which are produced in accordance with this invention.

A number of techniques were unsuccessfully tried to obtain glycerides of AA and DHA in an economic and practicable manner which would be suitable for use in an enteral formula such as infant formula. One of the unsuccessful techniques was thermal cracking. When egg yolk lipids and water were mixed and heated, there was a severe foaming problem. When water was limited to one equivalent based on phospholipid, foaming could be controlled. After 5 minutes at 250° C. with no solvent, TLC (thin layer chromatography) showed a mixture of triglyceride and diglyceride and starting material (phospholipid). However, the reaction mixture was very dark in color and non-homogeneous. The dark color was indicative of decomposition. Lowering the temperature to 200° C. for 30 minutes showed no benefits.

Still another advantage of this invention is the finding that temperatures of up to about 250 degrees C. can be used in some of the method steps without decomposition or appreciable darkening of the AA and DHA or esters thereof. This is believed to be unexpected since a test conducted with methyl oleate began to darken at about 75° C.

DETAILED DESCRIPTION OF THE INVENTION

Naturally occurring lipid mixtures high in polyunsaturated fatty acids are derived from animal and vegetable matter. Sources of lipid mixtures include: marine animals such as blue-colored fish, e.g., the mackerel, sardine, mackerel pike and herring; salmon; cod liver oil; plankton, krill and the various shrimp-like copepods; eggs; green leafy vegetables such as spinach, broccoli, and purslane; and oilseeds such as soya, sunflower, flax, canola, rapeseed, and cotton seeds. Any source of lipid mixtures high in polyunsaturated fatty acids may be used in the process of the present invention.

The lipid mixture is separated from the animal or vegetable matter by extraction or leaching with a solvent such as alcohol or hydrocarbon. Illustrative of solvents for leaching or extracting lipids are the lower alkanols having from 1 to 4 carbon atoms such as methanol, ethanol, isopropanol, and the like; hydrocarbons such as hexane; ethers such as petroleum ether and diethyl ether; lower alkanes under pressure such as those having from 3 to 4 carbon atoms and halogen substituted lower alkanes such as trichloromethane and dichloromethane; ketones such as acetone; as well as mixtures of the foregoing. For example, egg yolk powder may be mixed with a lower alkanol, e.g., methanol, which yields a lipid mixture containing phospholipids, triglycerides and sterols in liquid form, and solid protein material. The solid protein material is easily separated from the lipid mixture by methods known in the art such as filtration or centrifugation.

The preferred lipid source is egg yolks. The egg yolks used in this invention are generally derived from various avian species such as the hen, turkey, etc. and preferably the hen. However, eggs of other animals can be used, e.g. that of fish such as salmon eggs as well as eggs of turtles.

A typical composition of hen's egg yolks as found in Sim, J. S. et al., Egg Uses and Processing Technologies, page 120 (1994) is as follows on a percent by weight basis:

47.5% water, 33.0% lipids, 17.4% protein, 0.20% of carbohydrates (free), 1.1% of inorganic elements; and others of 0.8%. The lipid composition (from total lipids) is as follows: triglycerides of 71–73%, cholesterol of 4–6%, phospholipids of 23–25%.

Egg yolks can be in different forms such as liquid, frozen, or solid with or without conventional additives such as silica flow agents. Egg yolk solids can be obtained from eggs by various conventional means such as by spray drying egg yolks, freeze drying, etc. Egg yolk solids typically have 5% maximum moisture content, a pH of 6.5±3, a 56.0 wt % minimum fat content, protein of 30 wt % minimum. A preferred form of egg yolk useful in the present invention is egg yolk solids. The polyunsaturated fatty acid content of eggs can be varied by special diets that are fed to the avian. Such specialty eggs are useful in the process of the present invention.

The long chain unsaturated fatty acids such as AA and DHA in egg yolk lipids are found predominantly in the phospholipid fraction. In the methanol solution of the egg yolk lipids of this invention, the amount of lipids is typically about 38 wt %; the amount of AA is about 4 wt %; and the amount of DHA is about 1.5 wt % as determined by a relative fatty acid profile. However, the quantity of these lipid components can vary depending on the species of animal, its diet, time of year, etc.

The amount of phosphorus and cholesterol contained in the Processed Natural Ingredients is very low. Generally, the quantity of phosphorus can vary from about 1.0 wt % to 0.0001 wt % based on the Processed Natural Ingredients. It is preferred that the quantity of phosphorus be less than 0.1 wt % and particularly less than 0.01 wt % of the Processed Natural Ingredients. Generally, the quantity of sterols contained in the Processed Natural Ingredients is low. Generally, the quantity of sterols can vary from about 5.0 wt % to 0.001 wt % based on the Processed Natural Ingredients. Further, the product produced according to this invention has a weight-to-weight ratio of AA to sterols of equal to or greater than 1.0. It is preferred that the quantity of sterols including cholesterol be less than 0.5 wt % and particularly less than 0.1 wt % based on the weight of the Processed Natural Ingredients. The distilled free fatty acids produced in accordance with this invention will also have the low phosphorus and low cholesterol levels give above for the Processed Natural Ingredients. It is particularly preferred that the fatty acid and ester products of this invention be essentially free of cholesterol, sterols and phosphorus compounds.

The quantity of organic solvent used for extracting lipids from a lipid source, can vary over a broad range sufficient to dissolve the lipids. In the case of egg yolk solids, such quantity can vary from about 40 ml to over 800 ml of methanol based on 100 grams (g) of egg yolk solids. Larger quantities of methanol can be used but such larger quantities serve little useful purpose since it needs to be removed in later steps of the process.

As can be seen in Example 4 herein the use of methanol to extract lipids from egg yolk provides an unexpected high concentration of AA in the egg lipid extract in the temperature range of about 20° C. to 68° C. and preferably 30° C. to 65° C.

By extracting egg yolk with methanol, a phospholipid-rich egg lipid extract is obtained. It is the phospholipids which contain most of the AA and DHA. When a solvent other than methanol is used for extracting the lipids, the extraction temperature can vary from about 0° C. to the boiling point of the solvent. The quantity of such other organic solvent can be the same as in the use of methanol.

The addition of a lower alkanol as used in the extraction of lipids from a lipid source or when simply added to a lipid mixture from which the triglycerides have not been separated from the phospholipids before hydrolysis causes the formation of two liquid phases when the temperature is maintained between 20° C. and 68° C., preferably 30° C. to 65° C. The top phase is comprised of phospholipids, sterols, and alcohol, the bottom phase is comprised of triglycerides and sterols. The triglyceride phase is removed by methods known in the art such as decantation. For lipid mixtures such as egg yolks in which the polyunsaturated fatty acids such as AA, DHA and EPA are predominantly bound in the phospholipids, the addition of the alcohol is convenient and an inexpensive method of removing the triglycerides. The addition of the lower alkanol does not interfere with the subsequent hydrolysis reaction. In case methanol is used as the lower alkanol for the phase separation, the methanol is preferably added in a mass ratio of about 0.5 to 1 to 3 to 1 alcohol to the source of the lipids. The addition of methanol outside this range either does not result in the formation of a two phase mixture or results in poor partitioning of triglycerides and phospholipids into their respective phases. Water can be used to assist in such separation and the quantity of water can vary over a wide range such as that of from about 1 wt % to about 100 wt % based on the source of the lipids.

After the lipids are dissolved in the methanol or other organic solvent, the insoluble egg yolk components such as protein are separated from the methanolic solution of lipids. This can be done by various conventional techniques such as the use of a filter press, centrifuging, vacuum filtration, etc.

In the case of egg yolk is extracted with methanol, the extract is preferably separated into a triglyceride phase and a phospholipid phase by the addition of water and centrifuging. Analysis of a sample with methanol as the solvent for extracting the lipids showed that the triglyceride phase had no detectable phosphorus and was low in cholesterol. A fatty acid distribution assay of such sample showed that the triglyceride phase contained only 0.37% AA and 0.13% DHA by wt. This demonstrates that the phospholipids were cleanly separated from the triglyceride fraction.

Although separation of phospholipids from triglycerides as described above prior to hydrolysis or transesterification is advantageous, it was found that the majority of cholesterol also separated into the phospholipid layer. Thus, an effective method for removing the cholesterol and other sterols from this or subsequent reaction mixtures needs to be used.

In the free fatty acid route, fatty acids, fatty acid esters, and mixtures thereof high in polyunsaturated fatty acids are prepared. The starting material can be derived from naturally occurring lipid mixtures and the resulting acids, esters and mixtures thereof of this invention have low levels of cholesterol, sterols and phosphorus compounds and are preferably essentially free of cholesterol, sterols, and phosphorus compounds.

In the first step, the lipid mixture containing phospholipids, triglycerides, and sterols is hydrolyzed in water to form a two-phase product containing a fatty acid phase comprised of free fatty acids and sterols, and an aqueous phase comprised of water, glycerol, and glycerol phosphoric acid esters.

The hydrolysis of the lipid mixture may be catalyzed by either the addition of an acid or a base. Preferably, the hydrolysis of the lipid mixture is accomplished by a base-catalyzed hydrolysis reaction. Such base-catalyzed hydrolysis reactions are commonly known as saponification reactions. Suitable base catalysts are aqueous alkali which include sodium, lithium, calcium, and potassium salt of an hydroxide, carbonate or bicarbonate. Combinations of base catalysts may also be used.

The hydrolysis reaction is an equilibrium-limited reaction. The base-catalyzed reaction is driven to completion through the formation of a metal salt of the corresponding fatty acid. The base catalyst is added in at least a stoichiometric amount up to two times the stoichiometric amount based on the equivalents of fatty acid groups contained in the lipid mixture. Preferably, the base catalyst is added in an amount of 1.1 to 1.5 times the equivalent of fatty acid groups contained in the lipid mixture.

In a base-catalyzed hydrolysis the metal salts of fatty acids formed during hydrolysis are acidified to a pH of 4 or less with a mineral acid to form a two-phase product containing a fatty acid phase comprised of free fatty acids and sterols, and an aqueous phase comprised of water, glycerol, and glycerol phosphoric acid ester residues.

Mineral acids useful for the acidification of the metal salts of the fatty acids must have a pKa lower than the pKa of the free fatty acid. Suitable mineral acids include sulfuric acid, nitric acid, hydrochloric acid, and phosphoric acid, Combinations of mineral acids may also be used. The mineral acid is added in at least a stoichiometric amount based on the amount of base catalyst. The mineral acid may be added in dilute or concentrated form. A preferred mineral acid is aqueous hydrochloric acid.

In the absence of a suitable quantity of lower alkanol, unreacted phospholipids and hydrolyzed phospholipid residues act as surfactants and may interfere with the formation of distinct fatty acid and aqueous phases. In the event that the lipid mixture does not contain a lower alkanol in suitable quantity, a lower alkanol may be added to the hydrolysis product to assist in two-phase formation. The alcohol solubilizes the fatty acids and helps partition the surfactant residues into the aqueous phase. The alcohol is added at a 0.5:1 to 3:1, preferably a 1.5:1 mass ratio of alcohol to phospholipid present in the lipid mixture fed to Step (A). Examples of lower alkanols suitable to aid in two-phase formation include methanol, ethanol, propanol, isopropanol, isobutanol, and butanol. The addition of lower alkanol outside this range either does not result in the formation of a two phase mixture or results in poor partitioning of triglycerides and phospholipids into their respective phases.

In the second step, the aqueous phase is separated from the fatty acid phase of the two-phase product. The aqueous phase is removed by methods known in the art such as decantation. It is important to note that at acidic pH, the fatty acids may form fatty acid alcohol esters with any lower alkanol used optionally in Step (A). The fatty acid alcohol esters are undesirable as they represent a yield loss of fatty acids. Therefore, it is desirable that: (1) the two-phase product formed in Step (A) be maintained at a low temperature to slow the ester-ification reaction, but at a temperature which maintains the fatty acids as a liquid phase, between 35° C. to 55° C., preferably 40° C. to 50° C.; and (2) the aqueous phase should be removed as soon as practical from the two-phase product.

In the third step, the fatty acid phase is heated at a temperature of about 150° C. to about 250° C., preferably 170° C. to 230° C., to allow the fatty acids to react with the sterols to form sterol fatty acid esters and water. Optionally, water is removed to drive the reaction toward the formation of the sterol fatty acid esters. The formation of sterol fatty acid esters represents a yield loss of fatty acids, including a statistical distribution of polyunsaturated fatty acids based on their percentage in the mixture, equal to one mole of fatty acid for each mole of sterol ester formed. This yield loss is necessary in order to convert the sterols into sterol esters which can be separated easily from the fatty acids.

Optionally an esterification catalyst can be added to increase the rate of sterol fatty acid ester formation. Examples of suitable esterification catalysts include: dibutyl tin oxide, phosphoric acid, zinc oxide, hydrochloric acid, and butyl stannoic acid.

In the fourth step, the fatty acid and sterol ester mixture is distilled at a temperature of about 130° C. to about 250° C. and a pressure of about $1.0\times10^{-3}$ kPa to about $5.3\times10^{-1}$ kPa, to recover purified fatty acids. The distillation is preferably conducted at a temperature of 180° C. to 220° C. and a pressure of $1.0\times10^{-3}$ kPa to $5.3\times10^{-1}$ kPa. The fatty acids are relatively volatile and distill overhead, while the sterol fatty acid esters are not volatile and remain with the residue. The molecular weight distribution of the fatty acid residues of subsequently derived glyceride products can be controlled by distillation. For example, the lower molecular weight fatty acids tend to be the lower boiling fatty acids and concentrate in the first fractions of the distillation; and the higher molecular weight acids are found in the higher boiling fractions. The resulting fatty acids are essentially free of sterol compounds and phosphorus. Successive distillation stages may be used to remove lighter acids and concentrate heavier polyunsaturated acids such as AA, DHA, and EPA.

The formation of sterol fatty acid esters are critical to the present invention in order to recover fatty acids in high yield which are free of sterols and sterol esters. The relative volatility between the high molecular weight polyunsaturated fatty acids such as AA, DHA, and EPA, and the sterol esters is relatively large. Thus, the polyunsaturated fatty acids can be separated sharply from the sterol esters with any single equilibrium stage, non-refluxed high vacuum distillation apparatus known in the art, including a wiped-film evaporator, a falling film evaporator, a short path evaporator, and a centrifugal molecular still.

Alternatively, the relative volatility of the free sterols and the high molecular weight polyunsaturated fatty acids such as AA, DHA, and EPA is relatively small. Thus, a sharp separation of free sterols from higher molecular weight polyunsaturated fatty acids is not practical by single equilibrium stage, non-refluxed high vacuum distillation methods.

Multistage fractional distillation devices with reflux which are capable of sharp separations between components of low relative volatility such as free sterols and fatty acids must operate at higher pressures and subsequently higher temperature in order to allow for sufficient pressure drop across the multistage column. The requisite higher temperatures required in a multistage distillation leads to undesirable heat degradation and cis-trans isomerization of the unsaturated fatty acids.

Other methods of separation of sterols such as crystallization or supercritical extraction are more difficult and expensive. The melting points of sterols and fatty acids overlap and a sharp separation requires complicated, expensive fractional crystallization equipment and refrigeration. Supercritical extraction requires expensive high pressure equipment to maintain the extractant at supercritical conditions.

Optionally, the purified fatty acids, free of sterols and phosphorus containing residues, may be mixed with a C1–C10 alkyl monohydric or polyhydric alcohol and heated to produce a fatty ester of the alcohol. Suitable monohydric alcohols include, for example, methanol, ethanol, propanol, isopropanol, and butanol. Suitable polyhydric alcohols include, for example, glycerin, propylene glycol, ethylene glycol, sorbitol, sucrose, erythritol, pentaerythritol, mannitol, fructose, glucose, xylitol, and lactitol. The monohydric or polyhydric alcohol is added in a molar ratio of 1 to 2 moles of fatty acid to each hydroxyl equivalent of the alcohol, preferably, in a molar ratio of 1.1 to 1.3 moles of fatty acid to each hydroxyl equivalent of the alcohol. Optionally, water may be removed during the esterification reaction to drive the equilibrium toward the ester product.

The Processed Natural Ingredients in the free fatty acid route are obtained after separation of the glycerides from the esterification reaction. Optionally the Processed Natural Ingredients are purified such as by deodorization and decoloration. The Processed Natural Ingredients can be the glyceride composition from the esterification reaction with glycerol. The Processed Natural Ingredients will contain at least 1 wt % of AA such as about 1 wt % to 15 wt % of AA and at least 0.1 wt % of DHA such as about 0.1 wt % to 5 wt % of DHA and less than 1.0 wt % of phosphorus and less than 5.0 wt % of cholesterol. Preferably, the ingredient produced according to this invention contains less than 0.1 wt % phosphorus and less than 0.5 wt % of the sterols including cholesterol.

The product produced according to this invention is further characterized in having a weight-to-weight ratio of AA to sterols (including cholesterol) of greater than or equal to 1.0.

It is envisioned that the product produced in accordance with this invention can be further processed to concentrate the levels of AA and DHA. Such additional processing includes freeze fractionation, super critical extractions and enzymatic transesterification.

It is often desirable to increase the ratio of the unsaturated fatty acids in relation to the saturated fatty acids. This can be accomplished by various fractionation techniques such as solvent fractionation, solid fractionation such as cold pressed techniques, etc. Such fractionation can rely on the melting or solidification temperatures of the saturated fatty acids and esters thereof in relation to the unsaturated fatty acids and esters thereof. The fractionation can be applied to the crude free fatty acids before the distillation step or to the purified free fatty acids thereof after distillation.

The triglyceride content in the Processed Natural Ingredients can vary from about 60%, preferably at least about 70% and particularly at least 85 to 90% based on the weight of the Processed Natural Ingredients composition. The remainder is generally that of various reactants, monoglycerides, diglycerides, intermediate products and solvents. Illustratively, such remainder can contain: alkanols and various other solvents as well as unreacted fatty acids or lower alkyl esters thereof.

A typical fatty acid profile of some of the more significant fatty acids of the product produced by the process of this invention is set forth in Table A below.

TABLE A

ANALYSIS OF EGG YOLK DERIVED TRIGLYCERIDE OF THIS INVENTION

| Fatty Acid | % of Total |
|---|---|
| C16:0 | 29.5 |
| C18:0 | 11.0 |
| C18:1 | 40.3 |
| C18:2 | 15.6 |
| C20:4w6 (AA) | 2.9 |
| C22:6w3 (DHA) | 0.8 |
| Total | 100.1 |

Other components:

| | Amount (mg/100 g) |
|---|---|
| Cholesterol | less than 50 |
| Phosphorus | less than 10 |

The Processed Natural Ingredient produced in accordance with this invention can be used in nutritional products such as infant formula or used in the form of supplements, i.e., pills or capsules.

The following examples are illustrative of the invention. All parts and percentages in the examples, as well as elsewhere in this application, are by weight. Room or ambient temperature is 23 degrees C., unless the context indicates otherwise.

EXAMPLE 1

Egg Powder Extraction

Type Y-1 Egg yolk solids of Henningsen Foods, Inc. of 14334 Industrial Road, Omaha Nebr. were used in this example. Such egg yolk solids have the following chemical and physical standards: moisture of 0.5% maximum; pH of 6.5±0.3; fat of 56% minimum; protein of 30% minimum; color of 40–60 ppm Betacarotene; and granulation so that 100% passes through U.S.S.S. #16 screen. Egg yolk solids (455.7 g) Henningsen Foods type Y-1 were placed in a beaker (2 liters [L]) with methanol (1 L), heated to 60° C. and stirred with a magnetic stir bar. The yellow slurry was stirred for 1 hour and after a brief cooling period the solids were removed by vacuum filtration. The insoluble egg yolk components contained in the funnel were washed with an additional amount of methanol (2×200 ml). The filtrate was placed in a 3-neck round bottom flask (1 L) and the methanol was removed by distillation. The acid content of the methanol lipid mixture was determined by titremetric measurement and an equal number of moles of sodium methoxide was added so as to neutralize any acid.

EXAMPLE 2

Egg Powder Extraction of Lipid With Various Solvents

| Solvent | Temperature | Yield % (fat) | % AA |
|---|---|---|---|
| 2:1 $CHCl_3/CH_3OH$ | 50–60° C. | 64.2 | 2.0 |
| Isopropyl alcohol | 50–60° C. | 60.0 | 1.8 |
| Methyl alcohol | 50–60° C. | 37.3 | 4.2 |
| Ethyl alcohol | 50–60° C. | 57.2 | 2.2 |
| Ethyl alcohol | 22° C. | 41.1 | 2.7 |
| Ethyl alcohol | 4° C. | 25.2 | 3.7 |

The above extractions were performed similarly to the extraction described in Example 1. It can be seen from the above table that mixture of trichloromethane and methanol gave a high yield of total fat but the AA was only 2.0% in the fat. The methyl alcohol gave a relatively low yield of total fat but a very high yield of AA in the fat. The isopropyl alcohol as well as the two runs of ethyl alcohol at 50–60 and 22° C. give relatively high yields of total fat but small yields of AA in the fat. The ethyl alcohol at 4 degrees C. gave the smallest yield of total fat but a relatively high yield of AA in the fat. It can be seen from the above that at temperatures above about 20 degrees C., the methanol was superior compared to the other solvents in the percentage of AA extracted in the lipids. At 4 degrees C. the percentage yield of AA in the fat had increased for ethanol but the yield was lower at that temperature for ethanol as to total fat and AA in comparison to the methanol.

EXAMPLE 3

Preparation of Triglycerides By Free Fatty Acid Route

A 500 mL three neck flask equipped with a mechanical stirrer, reflux condenser, addition funnel, thermowell, heating mantle, and nitrogen atmosphere was charged with 154 grams of lipid mixture prepared in a manner similar to Example 1 (obtained by the leaching of powdered egg yolk with methanol), 193 grams of methanol, and 28 grams of water. Sodium hydroxide (80 g of 50% dilution) was added through the addition funnel. The resulting mixture was heated at 64° C. for 145 minutes. Hydrochloric acid (84 mL of 12 N) was added over five minutes. An additional 14 mL of HCl was added in small portions until a pH of 2 was attained. Stirring was stopped and the phases were allowed to separate. The aqueous (bottom) phase was separated and contained 0.58% phosphorus. The organic phase weighed 128 g and contained 6% monoglycerides, 2% fatty acid methyl esters, 5% cholesterol, and free fatty acids.

The free fatty acids, 124 g, were charged to a 300 mL 3 neck flask equipped with a mechanical stirrer, water trap, thermowell, heating mantle, and a sparge tube. The mixture was heated at 170° C. for 4 hours with a nitrogen sparge of 100 mL/min. Residual methanol, 14 g, and water of reaction were collected, the resulting product was distilled at 245° C. and 0.5 Torr (0.0667 kPa) on a wiped film evaporator to give 83 g of distillate and 16 g residue. The distillate (fatty acids) contained 0.13% cholesterol and no detectable phosphorus. The residue contained predominantly cholesterol esters of fatty acids.

A sample of the distillate fatty acids, 67 g, was charged to a 300 mL 3 neck flask equipped with a mechanical stirrer, water trap, thermowell, heating mantle, reflux condenser, and sparge tube. The sample was warmed to 110° C., and 6.6 g of glycerin was added under nitrogen. The temperature was increased to 160° C. The resulting mixture was heated for 29 hours with a nitrogen sparge of 100 mL/min. The resulting product was passed through a wiped film evaporator at 0.4 Torr and 220° C. to remove excess fatty acids. The fatty acid distillate weighed 8 g, and the triglyceride residue weighed 50 g. Analysis of the triglycerides showed 96% triglycerides and 4% diglycerides. Total cholesterol was less than 0.13%.

EXAMPLE 4

Preparation of Triglycerides By Free Fatty Acid Route

A 22 L reaction vessel was charged with 7733 grams (g) of the methanol containing phase obtained from leaching 5 kg of powdered egg yolk with 9 L of methanol at 60° C. for 3 hours. The mixture was heated to reflux and 5.7 L of methanol was distilled off. To the resulting mixture was added 2.5 L of water, followed by 750 g of 50% NaOH solution. The resulting mixture was heated at reflux (65–70° C.) with stirring for 2.5 hours. The heat was removed, and 785 mL of concentrated HCl was slowly added while the temperature of the mixture was maintained above 50° C. Agitation was discontinued, and the phases were allowed to separate. The bottom phase was separated and weighed 5764 g and contained 0.31% phosphorus. The fatty acid phase weighed 1350 g and contained 5.2% cholesterol, 0.17% phosphorus, and 5.5% fatty acid methyl esters. The fatty acid phase was charged to a 3 L flask equipped with a N2 (nitrogen gas) sparge and water trap and was heated to 170° C. for 7 hours with a sparge rate of about 1 L/min. A total of 83 g of methanol/water mixture was collected during this time. The product weighed 1216 grams and contained 0.02% cholesterol.

The product was purified by distillation through a wiped film evaporator. Distillation at 180° C. and 0.5 Torr gave 215 g of distillate that contained 13% fatty acid methyl esters, 41% palmitic acid, and 24% oleic acid. The residue was redistilled at 280° C. to give 745 g of distillate and 151 g of residue. The residue contained mainly cholesterol esters. The distillate contained the larger fraction of higher molecular weight fatty acids than the crude material.

A 2 L flask equipped with a N2 sparge and water trap was charged with 708 g of the distillate obtained at 280° C. and with 71 g of glycerin. The resulting mixture was heated at 160° C. for 24 hours. The resulting product was transferred to the wiped film evaporator and distilled at 280° C. and 0.5 Torr to give 155 g fatty acid distillate and 480 g of triglyceride product. The triglyceride product contained 90% triglycerides and 9% diglycerides.

EXAMPLE 5

Preparation of Glycerides By Free Fatty Acid Route

A 300 ml flask equipped with a mechanical stirrer, water trap, and N2 sparge was charged with 80.5 g of fatty acid distillate recovered from Example 4, and with 7.82 g of glycerin. The resulting mixture was heated at 230° C. with a N2 sparge for 3 hours. The mixture contained 86% triglycerides and 12% diglycerides.

EXAMPLE 6

Preparation of Fatty Acids By Free Fatty Acid Route

The procedure descried in Example 4 was followed except the methanol was not distilled from the saponification step until after the NaOH was added. A 6060 g methanol solution of lipid mixture was mixed with 750 g of 50% NaOH. The resulting mixture was heated at reflux while 2 L of methanol was distilled from the mixture for 150 minutes. Water, 200 mL, was added back to the mixture and heating was continued an additional 30 minutes. The mixture was acidified to pH of 2 and was allowed to cool to 60° C. over a two hour period and the phases were separated. The fatty acid phase weighed 771 g and contained 20% fatty acid methyl esters.

EXAMPLE 7

Phase Separation of Fatty Acids in Free Fatty Acid Route

A 500 ml flask was charged with 83 g of an egg lipid mixture free of methanol, 122 ml of water, and 39 g of 50% NaOH solution. The resulting mixture was heated at 70° C. for 3 hours. Concentrated HCl (41 mL) was added over five minutes, causing a slight exotherm. The addition of HCl caused the product to form a sticky, solid phase which could not be cleanly separated from the aqueous phase. Methanol, 122 g, was added to the mixture at 60° C. while stirring. The resulting mixture was transferred to a warm separatory funnel and the phases were allowed to separate. The aqueous phase weighed 343 g and the fatty acid phase weighed 65.6 g. The fatty acid product contained less than 2% fatty acid methyl esters.

EXAMPLE 8

Separation of Cholesterol Esters in Free Fatty Acid Route

A 1213 g sample of fatty acids that had been treated to esterify cholesterol was charged to a steam jacketed addition funnel. The material was fed to a Rodney-Hunt wiped film molecular still at a rate of 5 mL/min. The temperature of the still was maintained at 150° C. and the pressure was 0.5 Torr. A total of 215 grams of distillate was collected. The distillate contained 41% palmitic acid, 24% oleic acid, 13% fatty acid methyl esters, and less than 0.5% of C20 fatty acids. The residue was charged to the addition funnel and fed to the molecular still at a rate of 3.5 mL/min while the temperature of the still was maintained at 230° C. and the pressure was 0.4 Torr.

The distillate weighed 547 g and contained 45% oleic acid, less than 1% fatty acid methyl esters, and greater than 3% of C20 and heavier fatty acids. The residue from this fraction was charged to the addition funnel and fed to the molecular still at a rate of 3.5 mL/min while the temperature was maintained at 250° C. and the pressure was 0.35 Torr. The distillate weighed 193 g and contained 47% oleic acid, no fatty acid methyl esters, and greater than 4% of C20 and heavier fatty acids. The residue weighed 151 g and contained mainly fatty acid sterol esters and less than 2% free fatty acids.

EXAMPLE 9

Extraction of Lipids With Methanol and Phase Separation of Triglycerides From Lipids A 3.8 $m^3$ (1,000 gal) glass-lined reactor equipped with a mechanical agitator, condenser, nitrogen, and vacuum system was charged with 453 kg (1,000 lb) of egg yolk powder and 1.14 $m^3$ (300 gal) of methanol. The resulting mixture was heated to 65° C. and agitated for three hours. After filtering off the protein residue and washing with methanol, the methanol-lipid filtrate was returned to the 3.8 $m^3$ (1,000 gal) reactor and heated with agitation to 45° C. The agitation was stopped and the mixture was allowed to settle for one hour, with the temperature maintained between 40–45° C. Phase separation spontaneously occurred. The bottom-phase was decanted off, sampled, and weighed. Analysis showed the bottom phase to weigh 96 lb and contained 94.9% triglyceride, 509 ppm phosphorus, and a fatty acid distribution on a relative basis of 0.6% arachidonic acid and 0% DHA. The top phase, upon stripping off methanol, weighed 245 lbs, and contained 4% triglycerides, 3.63% phosphorus, and a fatty acid distribution on a relative basis of 6.5% arachidonic acid and 2.0% DHA.

INDUSTRIAL APPLICABILITY

The Processed Natural Ingredients of this invention have utility in enteral formulas, nutritional supplements, parenteral formulas, and can serve as starting materials for various edible emulsifiers such as diacetyltartaric acid esters of mono- and diglycerides (DHTEM), succinylated mono- and diglycerides, and acylated mono- and diglycerides. The free fatty acids or lower alkyl esters of the fatty acids prepared from the egg yolk lipids can also serve as starting materials for the preparation of various other edible lipid ingredients such as polyglycerol esters, propylene glycol esters, sorbate esters, and the like.

Many variations will suggest themselves to those skilled in this art in light of the above detailed description. All such obvious modifications are within the full intended scope of the appended claims.

What is claimed is:

1. A process comprising the steps of:

(A) subjecting a lipid mixture containing cholesterol, phospholipids, triglycerides and sterols to hydrolysis to form a two phase product containing a fatty acid phase comprised of free fatty acids and sterols and an aqueous phase comprised of water, glycerol, and phosphorus compounds;

(B) separating the aqueous phase from the fatty acid phase;

(C) reacting the fatty acids with the sterols in the fatty acid phase from Step (B) to form a mixture comprising sterol fatty acid esters and water;

(D) distilling the fatty acids from the sterol fatty acid esters formed in Step (C) to separate and recover in the distillate free fatty acids wherein said acids have reduced concentration of cholesterol and other sterols, and phosphorus compounds in relation to the lipid mixture of Step (A).

2. A process according to claim 1 further comprising subjecting the distilled free fatty acids to treatment consisting of reacting of the fatty acids with a C1–C10 alkyl monohydric or polyhydric alcohol to produce a fatty acid esters.

3. The process of claim 1 wherein the lipid mixture is separated into a phase containing phospholipids and sterols and a phase containing the triglycerides and sterols by contacting the lipid mixture with a lower alkanol, separating the phospholipid phase from the triglyceride phase and using the phospholipid phase for the subsequent hydrolysis.

4. The process of claim 1 wherein the lipid mixture of Step (A) is a naturally occurring lipid mixture.

5. The process of claim 1 wherein the lipid mixture is that from the egg yolk of hens.

6. The process of claim 1, wherein the lipid mixture of step (A) comprises egg yolk lipids having AA and DHA, and further comprising, prior to step (A), contacting egg yolk with an organic solvent to form a solution of lipids, including sterols, in the solvent; and separating the lipids from insoluble egg yolk components.

7. The process of claim 6, wherein the egg yolk lipids are in the form of solids.

8. The process of claim 6, comprising a further step after the distilling step (D), of subjecting the free fatty acids from Step (D) to re-esterification with glycerol to produce a composition containing triglycerides of said free fatty acids.

9. The process of claim 8, wherein said triglycerides include esterified AA and DHA fatty acids.

10. The triglycerides produced by the process of claim 9.

11. The process of claim 6, wherein the organic solvent is a lower alkanol.

12. The process of claim 11, wherein the lower alkanol is methyl alcohol.

13. The process of claim 6, wherein said step (C) comprises reacting the fatty acids with the sterols in the fatty acid phase from Step (B) at a temperature of 150° C. to 250° C. to form a mixture comprising sterol fatty acid esters and water.

14. The process of claim 6, wherein said step (D) comprises distilling the sterol fatty acid esters formed in Step (D) at a temperature of 130° C. to 250° C. and a pressure of $1\times10^{-3}$ kPa to $5.3\times10^{-1}$ kPa, to recover purified fatty acids which are essentially free of cholesterol and other sterols, and phosphorus compounds.

15. The process of claim 1, wherein step (A) is carried out in the presence of an aqueous alkali to form a soap and in step (B) the two-phase product is produced by the addition of a mineral acid to a pH less than about 4.

16. The process of claim 6, wherein step (A) is carried out in the presence of an aqueous alkali to form a soap and in step (B) the two-phase product is produced by the addition of a mineral acid to a pH less than about 4.

17. The process of claim 6, comprising a further step after the distilling step (D) of reacting the separated fatty acids with a C1–C10 alkyl monohydric or polyhydric alcohol to produce fatty acid esters.

18. The process of claim 17, wherein the fatty acid esters contain at least 1 wt % of AA, at least 0.1 wt % of DHA, less than 0.1 wt % of phosphorus and less than 0.5 wt % of sterols.

19. The fatty acid esters produced by the process of claim 17.

20. The fatty acid esters produced by the process of claim 2.

* * * * *

UNITED STATES PATENT AND TRADEMARK OFFICE

CERTIFICATE OF CORRECTION

PATENT NO. : 6,063,946
DATED : May 16, 2000
INVENTOR(S) : Robert Alan Miller, Terrence Bruce Mazer, Scott Donald Barnicki, Charles Allan McCombs and Charles Edwan Sumner, Jr.

It is certified that error appears in the above-identified patent and that said Letters Patent is hereby corrected as shown below:

Title Page,
Item [75] Inventors, add -- Charles Allan McCombs of Kingsport, Tennessee--

Signed and Sealed this

Seventeenth Day of July, 2001

*Attest:*

Nicholas P. Godici

NICHOLAS P. GODICI
*Acting Director of the United States Patent and Trademark Office*

*Attesting Officer*